US007845174B2

(12) United States Patent
Parkman et al.

(10) Patent No.: US 7,845,174 B2
(45) Date of Patent: Dec. 7, 2010

(54) COMBUSTOR LINER WITH IMPROVED HEAT SHIELD RETENTION

(75) Inventors: Kenneth Parkman, Georgetown (CA); Stephen Phillips, Toronto (CA)

(73) Assignee: Pratt & Whitney Canada Corp., Longueuil (CA)

( * ) Notice: Subject to any disclaimer, the term of this patent is extended or adjusted under 35 U.S.C. 154(b) by 901 days.

(21) Appl. No.: 11/737,314

(22) Filed: Apr. 19, 2007

(65) Prior Publication Data

US 2008/0256955 A1 Oct. 23, 2008

(51) Int. Cl.
*F02C 1/00* (2006.01)

(52) U.S. Cl. ..... 60/756; 60/752; 60/800

(58) Field of Classification Search ..... 60/752–760, 60/800

See application file for complete search history.

(56) References Cited

U.S. PATENT DOCUMENTS

| | | | | |
|---|---|---|---|---|
| 4,870,818 | A | 10/1989 | Suliga | |
| 5,181,377 | A | 1/1993 | Napoli et al. | |
| 5,289,677 | A | 3/1994 | Jarrell | |
| 5,323,601 | A | 6/1994 | Jarrell et al. | |
| 5,396,759 | A * | 3/1995 | Richardson | 60/804 |
| 5,419,115 | A | 5/1995 | Butler et al. | |
| 5,934,066 | A | 8/1999 | Schmid et al. | |
| 5,956,955 | A | 9/1999 | Schmid | |
| 6,497,105 | B1 | 12/2002 | Stastny | |
| 6,978,618 | B2 * | 12/2005 | Pacheco-Tougas et al. | 60/752 |
| 2005/0086940 | A1 * | 4/2005 | Coughlan et al. | 60/752 |

FOREIGN PATENT DOCUMENTS

| | | |
|---|---|---|
| GB | 2223839 | 4/1990 |

* cited by examiner

*Primary Examiner*—Michael Cuff
*Assistant Examiner*—Young Choi
(74) *Attorney, Agent, or Firm*—Ogilvy Renault LLP

(57) ABSTRACT

A combustor liner including a dome section having a positioning hole defined at a first radial distance and sized to receive a first heat shield fastener to at least substantially prevent radial and circumferential motion of the first fastener, a circumferential slot sized to receive a second heat shield fastener to at least substantially prevent radial motion of the second fastener while allowing limited circumferential motion of the second fastener, and a clearance hole defined at a second radial distance and sized to receive a third heat shield fastener to allow limited radial and circumferential motion of the third fastener.

22 Claims, 3 Drawing Sheets

COMBUSTOR LINER WITH IMPROVED HEAT SHIELD RETENTION

TECHNICAL FIELD

The invention relates generally to a gas turbine engine combustor and, more particularly, to an improved combustor liner retaining a heat shield while allowing for relative thermal deflections.

BACKGROUND OF THE ART

In a gas turbine engine combustor, high temperature alloy heat shields are generally used to protect the combustor structure from the heat generated from the combustion process. As a result a heat shield mounting structure that can accommodate relative thermal deflections between components is generally provided to attach the heat shield to the combustor. Typical shield mounting structures include fasteners, for example studs, protruding from the heat shield and received in clearance holes defined in the combustor liner. Such clearance holes usually have a diameter sufficiently greater than that of the fastener received therein to accommodate the relative motion of the fastener caused by the thermal deflections.

It is known to retain each fuel injector within its respective opening defined in the combustor liner with the help of the heat shield. The large clearance holes generally used to retain the heat shield fasteners produce a certain inaccuracy in the location of the heat shield, thus in the location of critical features such as the fuel injector to combustor interface. While this inaccuracy may be acceptable in large engines, it can become problematic in smaller engines because of the reduced engine scale, the minimum available space, and the required manufacturing tolerances which do not scale with the engine size. In addition, smaller engines usually include an internal fuel manifold which increases the relative thermal deflections, thus increasing the necessary size of the clearance holes and as such the inaccuracy in the location of the heat shield.

Accordingly, improvements are desirable.

SUMMARY OF THE INVENTION

It is therefore an object of this invention to provide an improved combustor liner.

In one aspect, the present invention provides a combustor liner for a gas turbine engine, the liner being adapted to retain a plurality of heat shield portions each including at least first, second and third protruding fasteners, the combustor liner comprising a dome section having for each heat shield portion a positioning hole defined at a first radial distance from a central axis of the liner, the positioning hole being sized to receive the first fastener to at least substantially prevent radial and circumferential motion of the first fastener within the positioning hole, a circumferential slot extending circumferentially with respect to the central axis, the circumferential slot being sized to receive the second fastener to at least substantially prevent radial motion of the second fastener within the slot while allowing limited circumferential motion of the second fastener within the slot, and a clearance hole defined at a second radial distance from the central axis, the clearance hole being sized to receive the third fastener to allow limited radial and circumferential motion of the third fastener within the clearance hole, the limited circumferential motion of the second fastener within the slot and the limited radial and circumferential motion of the third fastener within the clearance hole accommodating a difference in thermal expansion between the dome section and each of the heat shield portions.

In another aspect, the present invention provides a combustor liner for a gas turbine engine, the liner comprising an annular dome section interconnecting annular inner and outer walls of the liner, the dome section having a plurality of openings defined therethrough sized to each receive a fuel nozzle, the dome section also having a circular positioning hole, a circumferential slot and at least one clearance hole defined therethrough in proximity of each of the openings for receiving a respective fastener of a heat shield surrounding the fuel nozzle, the circular positioning hole having a first diameter, the circumferential slot extending circumferentially with respect to a central axis of the liner and having a radially defined width corresponding to the first diameter and a circumferentially defined length larger than the width, and the at least one clearance hole being larger than the circular positioning hole and being defined at a different radial distance than that of the positioning hole with respect to the central axis.

In another aspect, the present invention provides a combustor liner for a gas turbine engine, the combustor liner including an annular inner wall, and annular outer wall, and a radially extending dome section interconnecting the inner and outer walls, the dome section including means for retaining a first element of a heat shield at a first radial distance from a central axis of the liner while at least substantially preventing relative radial and circumferential motion between the first element and the dome section, means for retaining a second element of the heat shield while at least substantially preventing relative radial motion between the second element and the dome section and allowing a predetermined amount of relative circumferential motion between the second element and the dome section, and means for retaining a third element of the heat shield at a second radial distance from the central axis of the combustor while allowing a predetermined amount of relative radial and circumferential motion between the third element and the dome section.

In a further aspect, the present invention provides a method of accommodating relative thermal deflections between a heat shield and a dome section of a combustor for a gas turbine engine, the heat shield being connected to the dome section by at least first, second and third fasteners having a fixed position with respect to the heat shield, the first and third fasteners being engaged to the dome section at a different radial distances from a central axis of the dome section, the method comprising at least substantially preventing relative radial and circumferential motion between the first fastener and the dome section, at least substantially preventing relative radial motion between the second fastener and the dome section while allowing a limited relative circumferential motion between the second fastener and the dome section, and allowing a limited relative radial and circumferential motion between the third fastener and the dome section.

Further details of these and other aspects of the present invention will be apparent from the detailed description and figures included below.

DESCRIPTION OF THE DRAWINGS

Reference is now made to the accompanying figures depicting aspects of the present invention, in which.

DETAILED DESCRIPTION OF THE PREFERRED EMBODIMENTS

Figure 1:
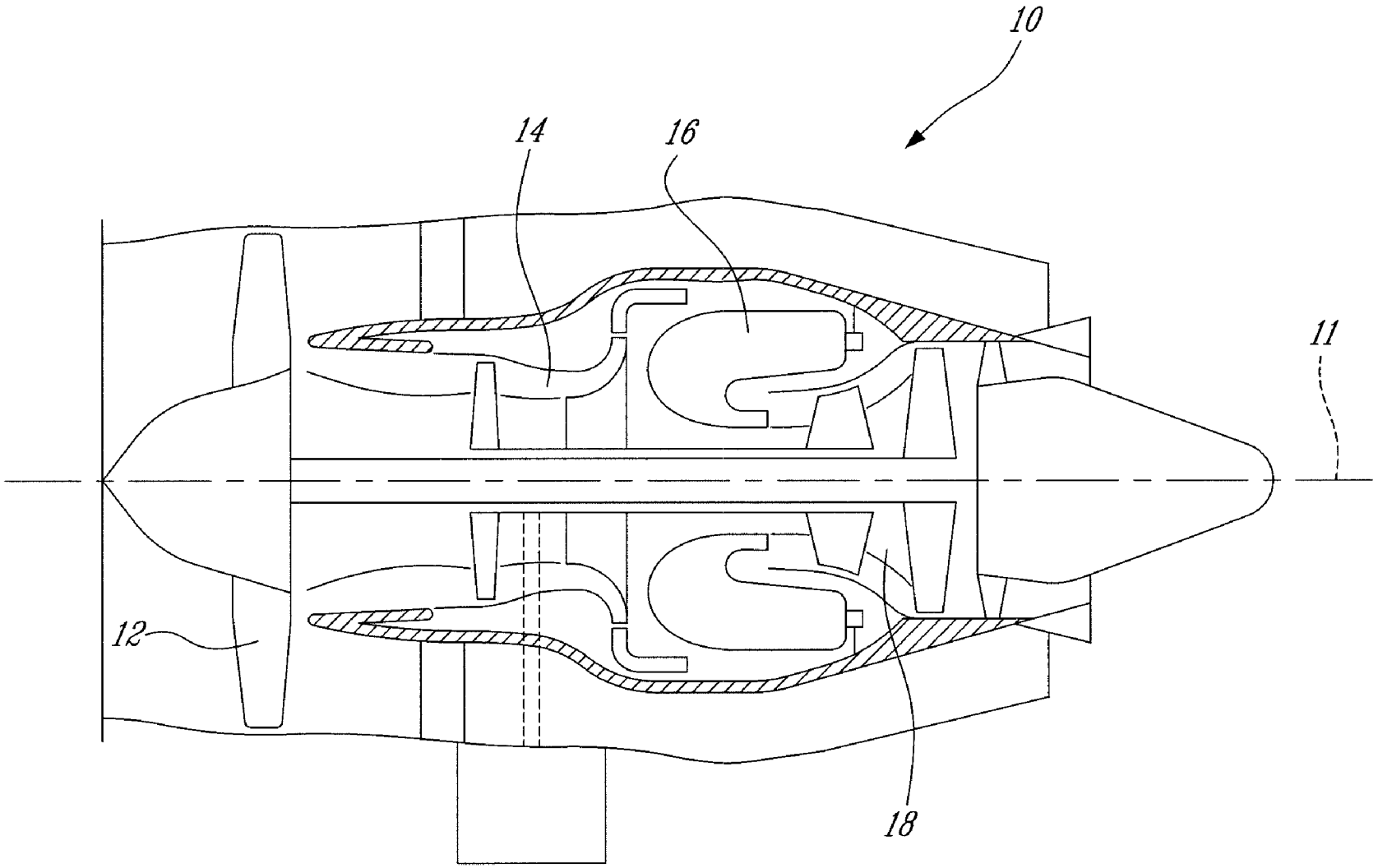
FIG. 1 is a schematic cross-sectional side view of a gas turbine engine in which the present invention can be used.

FIG. 1 illustrates a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases.

Figure 2:
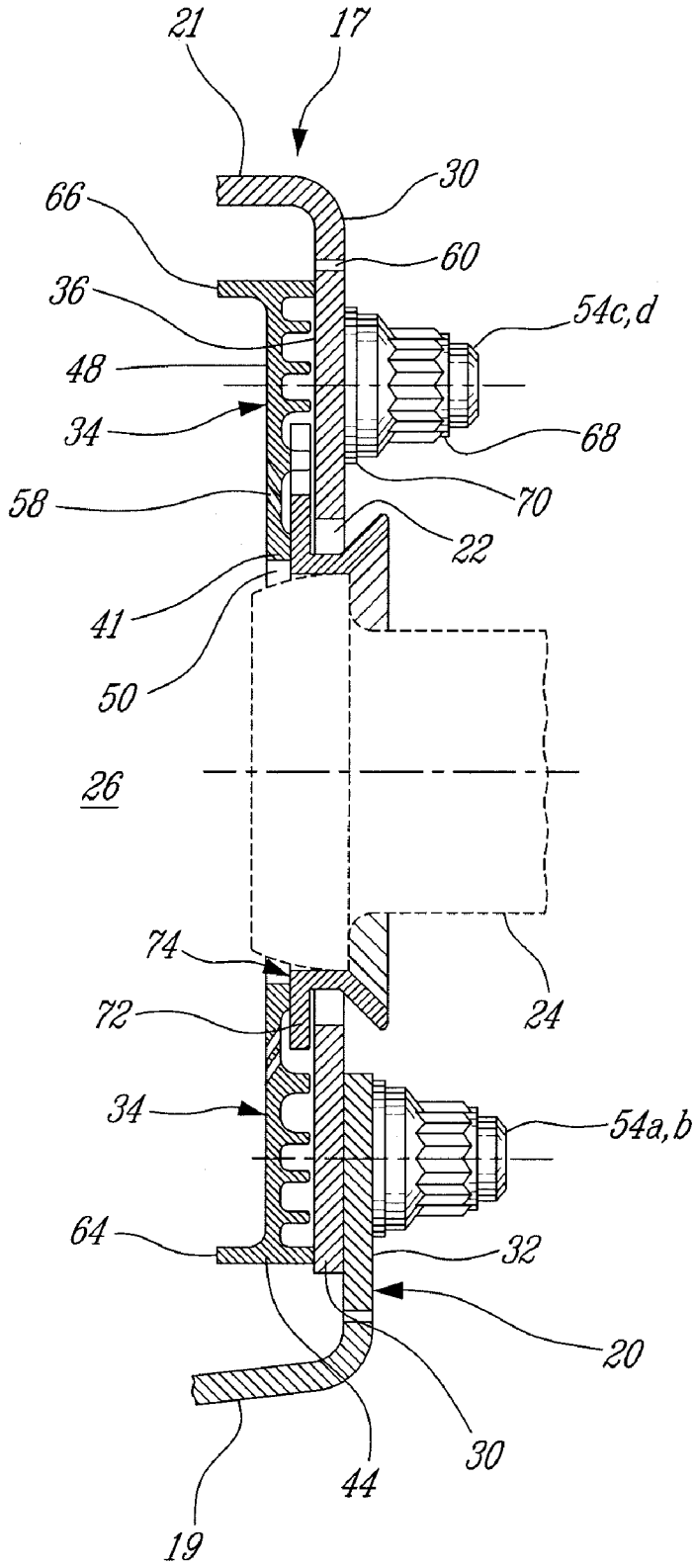
FIG. 2 is a side, cross-sectional view of a dome and heat shield assembly in accordance with a particular aspect of the present invention.

Referring to FIG. 2, the combustor 16 comprises a liner 17 which includes an annular inner liner wall 19 and an annular outer liner wall 21 radially spaced from one another, and interconnected at their upstream ends by an annular dome wall or bulkhead 20, to form an annular combustor chamber 26.

A plurality of passage openings 22 (only one shown) are provided in the dome 20, each one receiving the outlet end of a fuel nozzle 24 which is mounted for delivery of fuel and air into the combustor chamber 26. The passage openings 22 are equally spaced around the dome 20.

The dome 20 has a first annular section 30 which integrally extends radially inwardly from the annular outer liner wall 21, and a second annular section 32 which integrally extends radially outwardly from the annular inner liner wall 19. The first and second sections 30, 32 are overlapped in part, adjacent to the annular inner liner wall 19. The passage openings 22 are located in the first annular section 30 of the dome 20.

The dome 20 is particularly vulnerable to overheating as a result of the combustion process which takes place within the combustor chamber 26. In order to provide thermal shielding of the dome 20, segmented heat shields 34 are attached to the downstream side of the first annular section 30 of the dome 20, covering an inner surface 36 of the dome 20.

In a particular embodiment, each heat shield 34 is of generally truncated sectoral configuration and includes a shield plate 48 having a circular opening 50 with a diameter smaller than the passage openings 22 of the dome 20 and greater than the periphery of the outlet end of the fuel nozzle 24. A first circular ridge 41 extends from the shield plate 48 and defines the periphery of the opening 50. A second circular ridge 44 extends from the shield plate spaced apart from the ridge 41, and has a thickness greater than the thickness of ridge 41. It is understood that a number of different heat shield configuration can alternately be used.

The heat shield 34 includes two radially inner fasteners 54*a,b* and two radially outer fasteners 54*c,d* extending from the shield plate 48. When the heat shield 34 is mounted to the dome 20, the radially outer fasteners 54*c,d* extend through mounting holes in the first annular section 30 and the radially inner fasteners 54*a,b* extend through mounting holes in the first and second annular sections 30, 32 to securely join together the overlapped portions of the first and second annular sections 30, 32 to form the assembled dome 20.

In a particular embodiment, the fasteners 54*a,b,c,d* include threaded studs integrally cast with the heat shield 34, and incorporate at their base a controlled pilot shoulder 56. The threaded studs engage with self-locking nuts 68 and washers 70 to secure the heat shield 34 to the dome 20 and to join together the first and second annular sections 30, 32.

Small holes 60 in the dome 20 form cooling air passages to direct pressurized cool air from outside of the combustor chamber 26, through the space between the heat shield 34 and the dome 20, entering the combustor chamber 26 to cool the dome 20 and the heat shield 34. Small holes 58 can optionally be defined in the heat shield 34 to form additional cooling air passages. The heat shield 34 further includes inner and outer ridges 64, 66 extending from the shield plate 48 towards the inside of the combustor chamber 26 to form air channels to improve cooling.

In a particular embodiment, the second annular ridge 44 abuts the inner surface 36 of the dome 20, and the first annular ridge 41 abuts an annular radial flange 72 of a nozzle collar 74. Again, it is understood that a number of different heat shield configuration can alternately be used. The cooperating heat shield 34 and dome 20 axially restrain the position of the nozzle collar 74 with respect to the dome 20, while permitting limited radial and circumferential displacement of the nozzle collar 74 with respect to the dome 20 and the heat shield 34. The nozzle collar 74 is positioned within the passage opening 22 of the dome 20 to accommodate the fuel nozzle 24, sealingly contacting the outer periphery of the nozzle 24 to inhibit pressurized air outside the combustor chamber 26 from uncontrollable admission into the combustor chamber 26.

As the temperature of the fuel nozzles 24 is dictated by the relatively cool fuel manifold (not shown) to which they are connected, and the combustor liner 17 is submitted to substantially hot temperatures, relative thermal deflections may occur between the fuel nozzles 24 and the dome 20. The heat shield 34 is submitted to the extreme internal temperatures of the combustor 16 and as such also undergoes thermal deflection relative to the dome 20. The dome 20 thus receives the fasteners 54*a,b,c,d* such as to accommodate these relative thermal deflections, while ensuring that the position of the heat shield 34 relative to the dome 20 is within acceptable limits.

Figure 3:
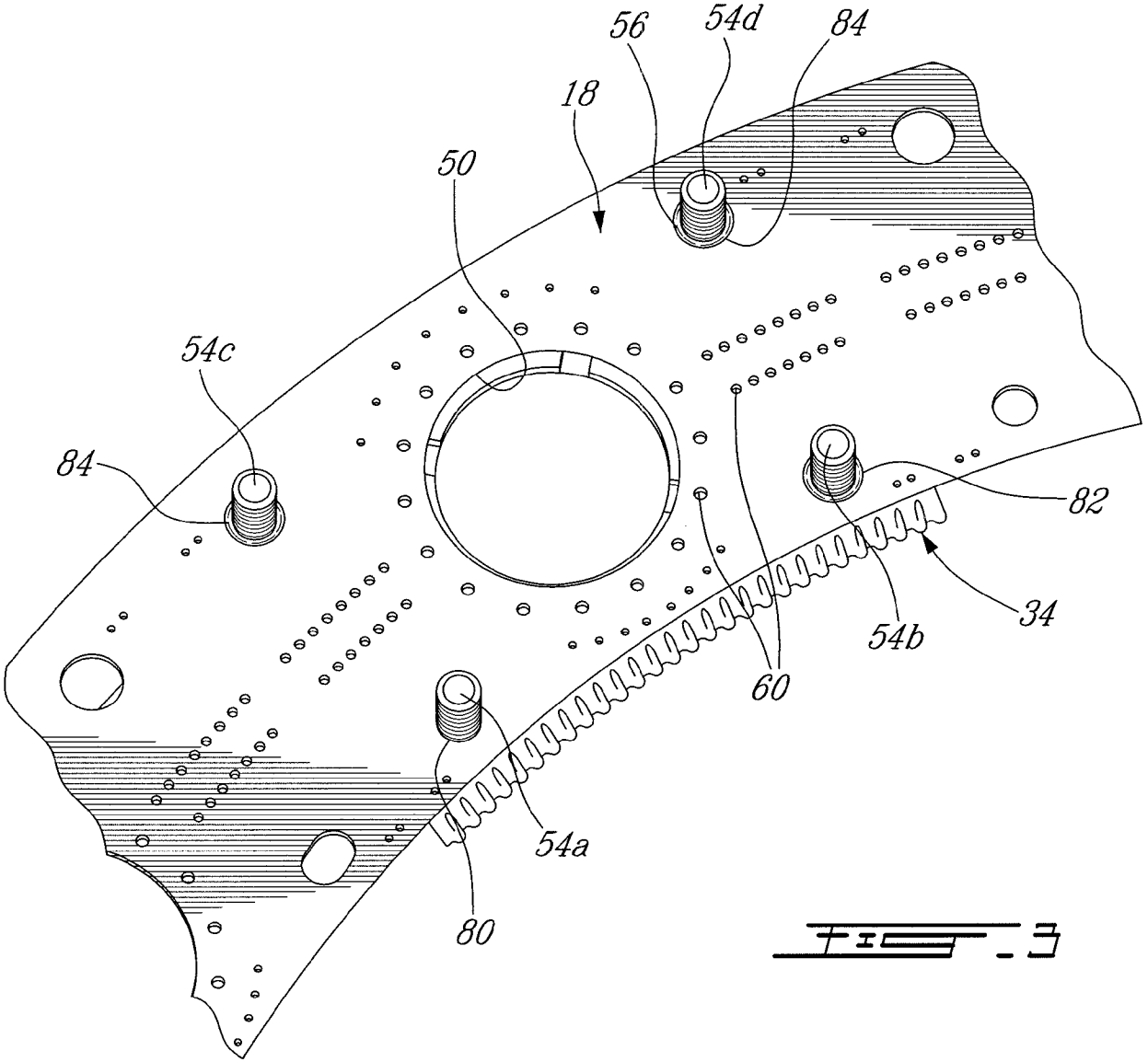
FIG. 3 is an isometric view of a portion of the dome and heat shield assembly of FIG. 2.

Referring to FIG. 3, the dome 20 includes a positioning hole 80, a circumferential slot 82 and two clearance holes 84 for receiving the fasteners 54*a,b,c,d*. In a particular embodiment, the positioning hole 80 and the circumferential slot 82 are located at a same radial distance from the engine or combustor centerline 11 (see FIG. 1), while the clearance holes 84 are located at a same radial distance from the centerline 11 which is greater than the radial distance between the positioning hole 80 and the centerline 11. Alternately, the positioning hole 80 and circumferential slot 82 can be located at different radial distances from the engine centerline 11.

The positioning hole 80 is a non-clearance hole receiving the positioning fastener 54*a* of the heat shield 34, which is one of the radially inner fasteners 54*a,b*. The positioning hole 80 is sized to receive the positioning fastener 54*a* while at least substantially preventing, and in a particular embodiment completely preventing, relative radial and circumferential motion of the positioning fastener 54*a* within the positioning hole 80.

The engagement of the positioning fastener 54*a* in the positioning hole 80 thus provides the relative location of the heat shield 34, and as such of the fuel nozzle receiving opening 50 and of the fuel nozzle 24 itself, with respect to the dome 20.

The circumferential slot 82 extends circumferentially with respect to the engine centerline 11. The width (i.e. dimension defined radially with respect to the dome 20) of the circumferential slot 82 is such as to receive the other radially inner fastener 54*b* while at least substantially preventing, and in a particular embodiment completely preventing, relative radial motion of the fastener 54*b* within the positioning slot 82. The length (i.e. dimension defined circumferentially with respect to the dome 20) of the slot 82 is greater than its width, thus allowing limited circumferential motion of the inner fastener 54*b* within the slot 82. In a particular embodiment where the inner fasteners 54*a,b* are identical, the width of the circumferential slot 82 corresponds to the diameter of the positioning hole 80.

The clearance holes 84 each receive one of the radially outer fasteners 54*c,d*. The clearance holes 84 have a diameter sufficiently greater than that of the outer fasteners 54*c,d* to allow for thermal deflections relative to the position of the positioning fastener 54*a*, i.e. to allow limited radial and circumferential motion of the fasteners 54*c,d* within their respective clearance hole 84. In a particular embodiment where the inner and outer fasteners 54*a,b,c,d* are identical, the diameter of the clearance holes 84 is thus greater than the diameter of the positioning hole 80.

In an alternate embodiment, the two clearance holes 84 are replaced by a single clearance hole receiving a single outer fastener of the heat shield 34. Alternately, more than two clearance holes 84 are provided, each receiving a respective fastener of the heat shield 34.

The heat shield 34 is thus accurately positioned in the radial and circumferential directions with respect to the dome 20 by the engagement of the radially inner fasteners 54*a,b* within the positioning hole 80 and circumferential slot 82. The relative thermal deflections between the dome 20 and the fuel nozzles 24, which is primarily in the radial direction, is accommodated by the motion of the floating nozzle collar 74 and by the limited radial motion of the outer fasteners 54*c,d* within the clearance holes 84. The relative thermal deflections between the dome 20 and the heat shield 34 are controlled in both the radial and circumferential directions, the deflections being allowed by the limited motion of the inner fastener 54*b* within the circumferential slot 82 and of the outer fasteners 54*c,d* within the clearance holes 84, and can be accommodated by the motion of the floating nozzle collar 74.

The configuration of the dome 20 described above thus provides for accurate positioning of the heat shield 34, especially in the radial direction, while still allowing for relative thermal deflections between the heat shield 34 and the dome 20, and between the fuel nozzles 24 and the dome 20.

The above description is meant to be exemplary only, and one skilled in the art will recognize that changes may be made to the embodiments described without department from the scope of the invention disclosed. For example, the positioning hole and circumferential slot can be located radially outwardly of the clearance holes, and/or the dome 20 can be made of a single layer of material instead of the superposed sections 30, 32. Still other modifications which fall within the scope of the present invention will be apparent to those skilled in the art, in light of a review of this disclosure, and such modifications are intended to fall within the appended claims.

What is claimed is:

1. A combustor liner for a gas turbine engine, the liner being adapted to retain a plurality of heat shield portions each including at least first, second and third protruding fasteners, the combustor liner comprising a dome section having for each heat shield portion a positioning hole defined at a first radial distance from a central axis of the liner, the positioning hole being sized to receive the first fastener to at least substantially prevent radial and circumferential motion of the first fastener within the positioning hole, a circumferential slot extending circumferentially with respect to the central axis, the circumferential slot being sized to receive the second fastener to at least substantially prevent radial motion of the second fastener within the slot while allowing limited circumferential motion of the second fastener within the slot, and a clearance hole defined at a second radial distance from the central axis, the clearance hole being sized to receive the third fastener to allow limited radial and circumferential motion of the third fastener within the clearance hole, the limited circumferential motion of the second fastener within the slot and the limited radial and circumferential motion of the third fastener within the clearance hole accommodating a difference in thermal expansion between the dome section and each of the heat shield portions.

2. The combustor liner as defined in claim 1, wherein the circumferential slot extends circumferentially at the first radial distance from the central axis.

3. The combustor liner as defined in claim 1, wherein the positioning hole is sized to completely prevent radial and circumferential motion of the first fastener within the positioning hole.

4. The combustor liner as defined in claim 1, wherein the circumferential slot is sized to completely prevent radial motion of the second fastener within the slot.

5. The combustor as defined in claim 1, wherein the first radial distance is smaller than the second radial distance.

6. The combustor as defined in claim 1, wherein the dome section has for each heat shield portion an additional clearance hole defined at the second radial distance from the central axis and sized to receive a fourth fastener of the heat shield portion to allow limited radial and circumferential motion of the fourth fastener within the additional clearance hole.

7. A combustor liner for a gas turbine engine, the liner comprising an annular dome section interconnecting annular inner and outer walls of the liner, the dome section having a plurality of openings defined therethrough sized to each receive a fuel nozzle, the dome section also having a circular positioning hole, a circumferential slot and at least one clearance hole defined therethrough in proximity of each of the openings for receiving a respective fastener of a heat shield surrounding the fuel nozzle, the circular positioning hole having a first diameter, the circumferential slot extending circumferentially with respect to a central axis of the liner and having a radially defined width corresponding to the first diameter and a circumferentially defined length larger than the width, and the at least one clearance hole being larger than the circular positioning hole and being defined at a different radial distance than that of the positioning hole with respect to the central axis.

8. The combustor liner as defined in claim 7, wherein the circumferential slot extends at a same radial distance than that of the positioning hole with respect to a central axis of the liner.

9. The combustor liner as defined in claim 7, wherein the circular positioning hole and the circumferential slot are defined in proximity of the inner wall, and the at least one clearance hole is defined in proximity of the outer wall.

10. The combustor liner as defined in claim 7, wherein the at least one clearance hole is circular and has a second diameter larger than the first diameter.

11. The combustor liner as defined in claim 7, wherein the at least one clearance hole includes two clearances holes defined at a same radial distance with respect to the central axis and circumferentially spaced apart from one another.

12. A combustor liner for a gas turbine engine, the combustor liner including an annular inner wall, and annular outer wall, and a radially extending dome section interconnecting the inner and outer walls, the dome section including means for retaining a first element of a heat shield at a first radial distance from a central axis of the liner while at least substantially preventing relative radial and circumferential motion between the first element and the dome section, means for retaining a second element of the heat shield while at least substantially preventing relative radial motion between the second element and the dome section and allowing a predetermined amount of relative circumferential motion between the second element and the dome section, and means for retaining a third element of the heat shield at a second radial distance from the central axis of the combustor while allowing a predetermined amount of relative radial and circumferential motion between the third element and the dome section.

13. The combustor liner as defined in claim 12, wherein the means for retaining the second element of the heat shield retain the second element at the first radial distance from the central axis.

14. The combustor liner as defined in claim 12, wherein the means for retaining the first element include a circular positioning hole defined in the dome section at the first radial distance from the central axis.

15. The combustor liner as defined in claim 12, wherein the means for retaining the second element include a circumferential slot extending circumferentially at the first radial distance from the central axis.

16. The combustor liner as defined in claim 15, wherein the means for retaining the first element include a circular positioning hole defined in the dome section at the first radial distance from the central axis, and the circumferential slot has a radially defined width corresponding to a diameter of the circular positioning hole.

17. The combustor liner as defined in claim 14, wherein the means for retaining the third element include a circular clearance hole having a diameter larger than that of the circular positioning hole.

18. The combustor liner as defined in claim 12, wherein the means for retaining the first and second elements are defined in proximity of the inner wall, and the means for retaining the third element are defined in proximity of the outer wall.

19. A method of accommodating relative thermal deflections between a heat shield and a dome section of a combustor for a gas turbine engine, the heat shield being connected to the dome section by at least first, second and third fasteners having a fixed position with respect to the heat shield, the first and third fasteners being engaged to the dome section at a different radial distances from a central axis of the dome section, the method comprising:

at least substantially preventing relative radial and circumferential motion between the first fastener and the dome section;

at least substantially preventing relative radial motion between the second fastener and the dome section while allowing a limited relative circumferential motion between the second fastener and the dome section; and allowing a limited relative radial and circumferential motion between the third fastener and the dome section.

20. The method according to claim 19, wherein the heat shield is also connected to the dome section by a fourth fastener engaged to the dome section at the second distance from the central axis of the dome section, and the method further comprises allowing limited relative radial and circumferential motion between the fourth fastener and the dome section.

21. The method according to claim 19, wherein the relative radial and circumferential motion between the first fastener and the dome section is completely prevented.

22. The method according to claim 19, wherein the relative radial motion between the second fastener and the dome section is completely prevented.

* * * * *